US006994422B2

(12) United States Patent
Park et al.

(10) Patent No.: US 6,994,422 B2
(45) Date of Patent: Feb. 7, 2006

(54) INK-JET PRINTHEAD AND MANUFACTURING METHOD THEREOF

(75) Inventors: Byung-ha Park, Gyeonggi-do (KR); Seo-hyun Cho, Gyeonggi-do (KR); Myung-jong Kwon, Seoul (KR); Yong-shik Park, Gyeonggi-do (KR); Kyong-il Kim, Gyeonggi-do (KR); Jae-sik Min, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/299,905

(22) Filed: Nov. 20, 2002

(65) Prior Publication Data

US 2003/0197762 A1 Oct. 23, 2003

(30) Foreign Application Priority Data

Apr. 17, 2002 (KR) ..... 2002-0020912

(51) Int. Cl.
*B41J 2/14* (2006.01)
*B41J 2/16* (2006.01)
*B41J 2/05* (2006.01)

(52) U.S. Cl. ..... 347/47; 347/56; 347/65

(58) Field of Classification Search ..... 347/45, 347/56, 61–65, 20, 44, 47, 67
See application file for complete search history.

(56) References Cited

U.S. PATENT DOCUMENTS 6,019,457 A 2/2000 Silverbrook
6,440,645 B1 * 8/2002 Yon-Hin et al. ..... 430/322

* cited by examiner

*Primary Examiner*—Juanita D. Stephens
(74) *Attorney, Agent, or Firm*—Staas & Halsey LLP

(57) ABSTRACT

An ink-jet printhead and a manufacturing method thereof include a substrate on which an ink chamber having a predetermined volume is formed, a passage for supplying ink to the ink chamber which is formed on a bottom of the ink chamber, a nozzle plate which includes a nozzle corresponding to a center of the ink chamber and at least two insulating layers formed on the substrate, a bubble guide formed inside the nozzle plate and extending from the nozzle into the ink chamber, and a heater which surrounds the nozzle and is disposed between the two insulating layers. A hydrophobic coating layer is formed on a surface of a uppermost layer of the nozzle plate, and a droplet ejecting portion that has a diameter smaller than that of the nozzle of the nozzle plate and is disposed on the same axis as the nozzle, is formed in the hydrophobic coating layer. The nozzle plate is prevented from becoming wet due to ink, stability of an ink spray and a consecutive spray performance are improved, and thus a printing quality and a printing performance of the ink-jet printhead are generally improved.

6 Claims, 17 Drawing Sheets

INK-JET PRINTHEAD AND MANUFACTURING METHOD THEREOF

CROSS-REFERENCE TO RELATED APPLICATIONS

This application claims the benefit of Korean Patent Application No. 2002-20912, filed Apr. 17, 2002, in the Korean Intellectual Property office, the disclosure of which is incorporated herein by reference.

BACKGROUND OF THE INVENTION

1. Field of the Invention

The present invention relates to an ink-jet printhead and a manufacturing method thereof, and more particularly, to a method of forming an anti-wetting layer on a nozzle plate and processing a nozzle when an ink-jet printhead is manufactured.

2. Description of the Related Art

Ink ejection mechanisms for ink-jet printers include an electro-thermal transducer ejecting ink by generating bubbles in ink using a heat source in a bubble-jet method, and an electro-mechanical transducer ejecting ink using volume variations of ink caused by the deformation of a piezoelectric device.

The bubble-jet method using the electro-thermal transducer is further divided into a top-shooting method, a side-shooting method, and a back-shooting method according to a growing direction of the bubbles and an ejecting direction of ink droplets. The top-shooting method is a method in which the growing direction of the bubbles is the same as the ejecting direction of the ink droplets, the side-shooting method is a method in which the growing direction of the bubbles is perpendicular to the ejecting direction of the ink droplets, and the back-shooting method is a method in which the growing direction of the bubbles is opposite to the ejecting direction of the ink droplets.

An ink-jet printhead supporting these ink ejection mechanisms includes a nozzle plate having a nozzle (orifice) through which the ink droplets are ejected. The nozzle plate directly faces paper to be printed on and presents various factors which may affect ejection of the ink droplets ejected through the nozzle. Among these factors, there is a hydrophobic property of a surface of the nozzle plate. When the hydrophobic property is limited, that is, when the nozzle plate has a hydrophile property, a portion of ink ejected through the nozzle is soaked into the surface of the nozzle plate and contaminates the surface of the nozzle plate, and a size, a direction, and a speed of the ejected ink droplets are nonuniform. In order to solve these problems, a coating layer for anti-wetting is formed on the surface of the nozzle plate.

FIGS. 1A and 1B are schematic cross-sectional views of a conventional ink-jet printhead 10 supporting a back-shooting method in which a surface of a multilayer nozzle plate 12 is anti-wetted. Referring to FIG. 1A, a hemispheric chamber 14 is formed at a center of a top surface of a substrate 11. A trapezoidal channel-shaped manifold 17 is formed under the chamber 14, and the chamber 14 and the manifold 17 are connected to each other through a passage 16. The multilayer nozzle plate 12 is formed on the top surface of the substrate 11. The nozzle plate 12 is a membrane that is formed by stacks formed on the substrate 10, and includes a nozzle (or orifice) 18, that is disposed at a center of the chamber 14 and a bubble guide 18*a* that is extended into an inside of the chamber 14 and is formed around the nozzle 18.

The nozzle plate 12 includes a lower insulating layer 12*a*, an intermediate insulating layer 12*b*, and an upper insulating layer 12*c*. A heater 13 surrounds the nozzle 18, is formed between the lower insulating layer 12*a* and the intermediate insulating layer 12*b*, and is connected to a pad 22. An interconnection layer 15 is connected to the heater 13 and is formed between the intermediate insulating layer 12*b* and the upper insulating layer 12*c*. In the above structure, the upper insulating layer 12*c* is formed of a single layer or multilayer stack. A hydrophobic coating layer 19 is formed on the upper insulating layer 12*c*. Preferably, the hydrophobic coating layer 19 is formed at least on the surface of the nozzle plate 12 around the nozzle 18. Here, metal, such as gold-plated nickel (Ni), gold (Au), palladium (Pd), or tantalum (Ta), and a perfluoronated alkane and silane compound with a high hydrophobic property, such as Fluorinated Carbon (FC), F-Silane, or Diamond Like Carbon (DLC), are used for the hydrophobic coating layer 19.

The hydrophobic coating layer 19 may be formed by a wetting method, such as a spray coating method or spin coating, and the hydrophobic coating layer 19 is deposited using a drying method, such as plasma enhanced-chemical vapor deposition (PE-CVD) and sputtering. The hydrophobic coating layer 19 is formed after the nozzle 18 and the chamber 14 have been already formed. In this case, when a hydrophobic material is inserted into the chamber 14 through the nozzle 18, a hydrophobic material layer 19' is formed on an entire surface or a part of a bottom surface of the chamber 14. In a worse case, the hydrophobic material layer 19' may be formed on an inner wall of the passage 16 connected to the manifold 17. When the hydrophobic material layer 19' is formed inside the chamber 14 and the passage 16, ink is not smoothly supplied to the chamber 14 due to the hydrophobic property of the hydrophobic material, or ink may not be supplied at all to the chamber. Thus, after the hydrophobic material is formed on the surface of the nozzle plate 12, the hydrophobic material layer 19' formed in the chamber 14 and the passage 16 is removed by a subsequent $O_2$ plasma etching process. However, when the hydrophobic material in the chamber 14 is removed using $O_2$ plasma, the nozzle plate 12, in particular, the hydrophobic coating layer 18 formed on the surface of the nozzle plate 12 may be excessively exposed to $O_2$ plasma, and thus may be severely damaged.

As shown in FIG. 1A, the nozzle 18 has a funnel shape in which an entire shape of the nozzle 18 is enlarged gradually from an end of the bubble guide 18*a* and finally opened widely to an outside of the nozzle, thereby forming an ink ejection portion having an enlarged and opened structure. The enlarged and opened structure is formed by a structural profile of a lower stack including the heater 13 and an interconnection layer 15.

The enlarged and opened structure is a portion in which ink 14*a* guided through the bubble guide 18*a* splits into droplets and ejected. When the droplets are ejected from the enlarged and opened ink ejection portion of the nozzle 18, pressure has been already lowered before the droplets are completely separated from the nozzle 18, and thus it is difficult to form the droplets having a preferable shape and a high speed. Since the droplets pass through the enlarged and opened portion when the progressing direction of the droplets is not guided while a sufficient progressing distance is maintained, the ejected droplets cannot travel straight in a stable manner.

FIG. 1B is a scanning electronic microscope (SEM) photo schematically illustrating a sectional structure of the conventional ink-jet printhead having the shape of the nozzle 18 in which an opened end is enlarged gradually and opened widely in a form of a funnel.

As shown in FIG. 1B, since the nozzle 18 is enlarged and opened via the bubble guide 18*a*, problems, such as a deteriorating straight-traveling property of the droplets, an occurrence of the droplets having no preferable shape, and a slow ejection speed of the droplets due to a hydrodynamic result caused by the shape of the nozzle, may occur. In order to solve the problems caused by the enlarged and opened nozzle 18, it is needed that the bubble guide and the enlarged and opened portion that are extended into the bubble guide, have predetermined consecutive diameters, or that the opening of the nozzle that extends into the bubble guide, has a cone shape and its diameter reduces gradually in the progressing direction of the droplets.

SUMMARY OF THE INVENTION

To solve the above and other problems, it is an object of the present invention to provide an ink-jet printhead having improved droplet ejection performances, such as an ejection speed and a straight-traveling property, by effectively designing and forming a hydrophobic coating layer, and a manufacturing method thereof.

Additional objects and advantageous of the invention will be set forth in part in the description which follows and, in part, will be obvious from the description, or may be learned by practice of the invention.

Accordingly, to achieve the above and other objects according to one aspect of the present invention, there is provided an ink-jet printhead. The ink-jet printhead includes a substrate on which an ink chamber having a predetermined volume is formed, and a passage supplying ink to the ink chamber formed on a bottom of the ink chamber, a nozzle plate which includes a nozzle corresponding to a center of the ink chamber and at least two insulating layers formed on the substrate, a bubble guide formed inside the nozzle plate and extending from the nozzle into the ink chamber, and a heater which surrounds the nozzle between the two insulating layers. A hydrophobic coating layer is formed on a surface of an uppermost layer of the nozzle plate, and a droplet ejecting portion has a diameter smaller than that of the nozzle of the nozzle plate, is disposed on the same axis as the nozzle, and is formed in the hydrophobic coating layer.

According to an aspect of the present invention, the droplet ejecting portion has a diameter that is reduced gradually in a droplet progressing direction. According to another aspect of the present invention, the droplet ejecting portion has a cylindrical portion that extends along the bubble guide of the nozzle plate toward the ink chamber.

According to another aspect of the present invention, the hydrophobic coating layer is formed of photoresist, more preferably, negative photoresist.

To achieve the above and other objects according to another aspect of the present invention, there is provided a method of manufacturing an ink-jet printhead including a substrate on which an ink chamber having an opened upper portion and a predetermined volume is formed, a nozzle which is formed on the substrate and corresponds to the opened portion of the ink chamber, a heater which surrounds the center axis of the nozzle, an interconnection layer that is electrically connected to the heater, and a nozzle plate which includes a stack formed by multilayer insulating layers which protect the heater and the interconnection layer.

The method includes a) forming the nozzle plate on a substrate, the nozzle plate including a stack formed by multilayer insulating layers, the heater that is buried in the stack and surrounds the center axis of the nozzle, and an interconnection layer that is connected to the heater, b) pushing the nozzle plate along the center axis and forming a well having a predetermined diameter and depth in the substrate, c) forming a cylindrical bubble guide having a predetermined thickness on an inner wall of the well, d) filling a sacrificial layer in the well, e) forming a hydrophobic coating layer on the nozzle plate and the entire top surface of the sacrificial layer using photoresist, f) forming a through hole-shaped droplet ejecting portion that has a diameter smaller than the diameter of the bubble guide and is disposed on the same axis as the bubble guide, in the hydrophobic coating layer, g) injecting an etchant into the droplet ejecting portion to remove the sacrificial layer in the well, h) injecting the etchant via the bubble guide into the droplet ejecting portion and forming an ink chamber having a predetermined volume around and under the bubble guide by etching the substrate using the etchant, and i) forming an ink supplying passage which communicates with the ink chamber, on the substrate.

According to another aspect of the present invention, in the filling of the sacrificial layer, the sacrificial layer is formed to have a height lower than the bubble guide in the well, and thus in the forming of the hydrophobic coating layer, the predetermined width of the hydrophobic coating layer overlaps a top end of the bubble guide. In addition, according to another aspect of the present invention, in the filling of the sacrificial layer, a top surface of the sacrificial layer has a concave shape.

It is possible that the sacrificial layer is formed of positive photoresist, and the hydrophobic coating layer is formed of negative photoresist.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1A:
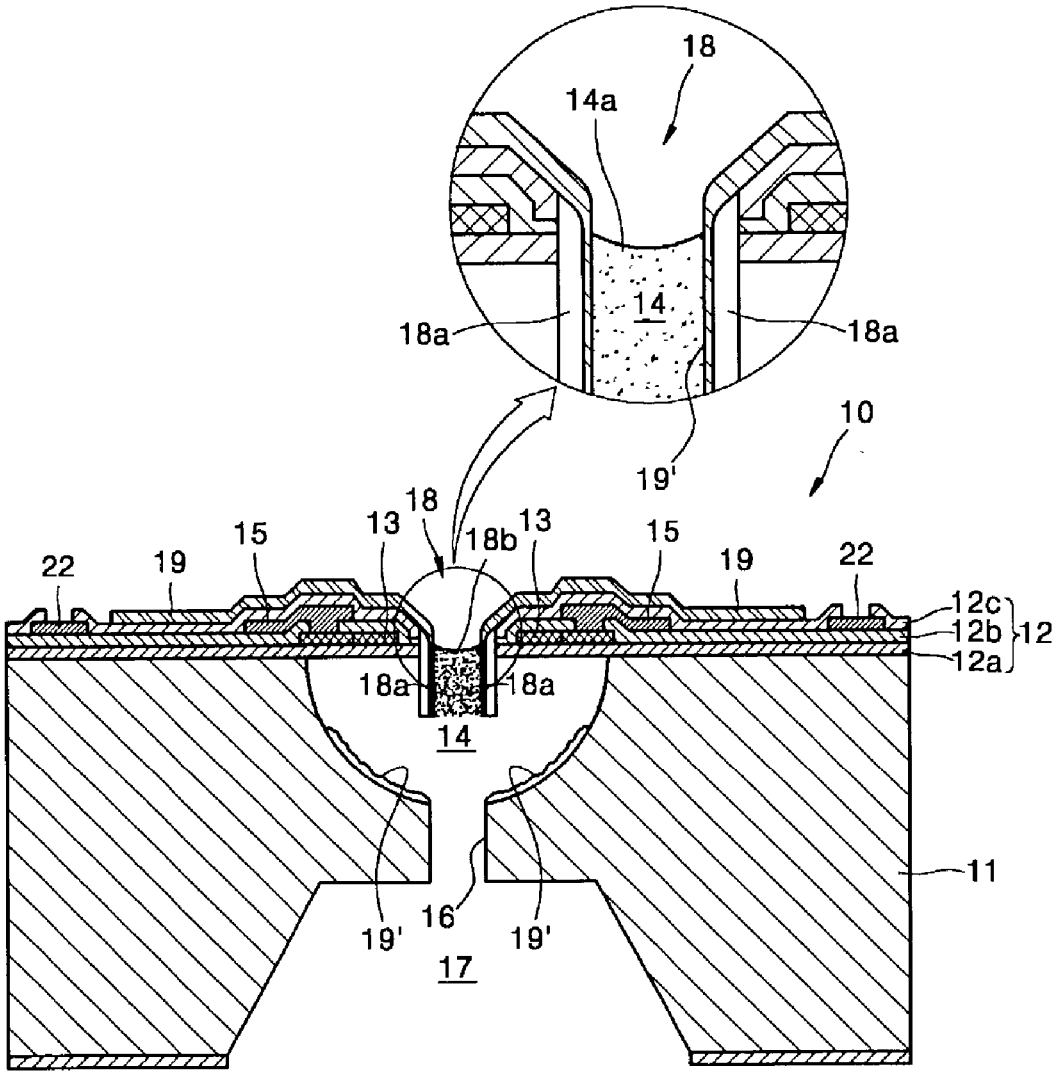
FIG. 1A (PRIOR ART)
FIG. 1A is a schematic cross-sectional view of a conventional ink-jet printhead to explain a method of forming a hydrophobic coating layer when the conventional ink-jet printhead is manufactured.
Figure 1B:
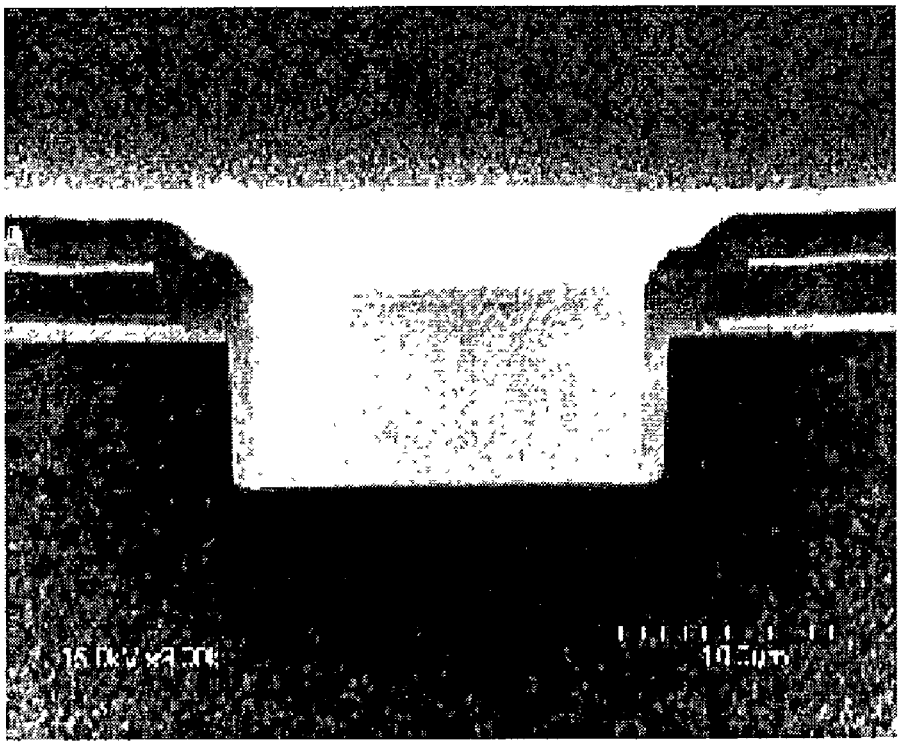
FIG. 1B (PRIOR ART)
FIG. 1B is a scanning electronic microscope (SEM) photo schematically illustrating a sectional structure of the conventional ink-jet printhead.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The present invention will be described more fully hereinafter with reference to the accompanying drawings in which preferred embodiments of the invention are shown.

Figure 2A:
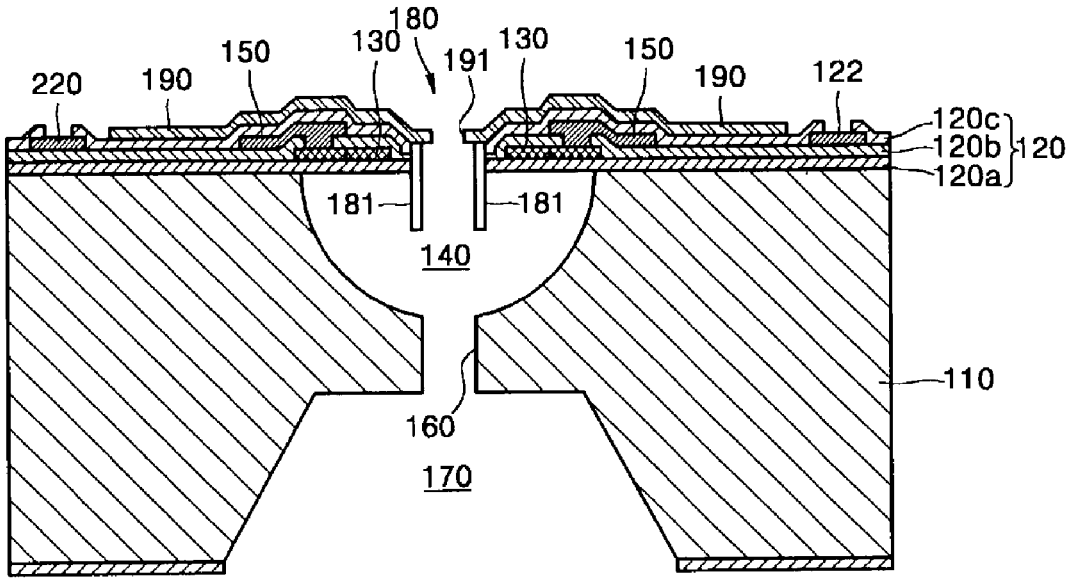
FIG. 2A is a schematic cross-sectional view illustrating an ink-jet printhead according to an embodiment of the present invention.

FIG. 2A is a schematic cross-sectional view illustrating an ink-jet printhead according to an embodiment of the present invention. The ink-jet printhead shown in FIG. 2A includes a cylindrical bubble guide 181, which is a part of a nozzle 180 through which droplets are ejected, formed on an inside of a nozzle plate 120, and a hydrophobic coating layer 190 in which a droplet ejecting portion 191, which is formed on the same axis as the nozzle 180, is formed on a surface of the nozzle plate 120. That is, the bubble guide 181 is formed in the nozzle 180, the droplet ejecting portion 191 having a diameter smaller than the nozzle 180 or the bubble guide 181 is formed outside the nozzle 180 or the bubble guide 181, and thus droplet ejection performances are improved.

Since the hydrophobic coating layer 190 is formed on the nozzle plate 120, the nozzle plate 120 is prevented from being wet due to ink remaining on a surface of the nozzle 180, and thus contamination of paper to be printed and a lower printing quality of the printed paper are avoided.

In addition, the droplet ejecting portion 191 having the diameter smaller than the bubble guide 181, is provided such that the droplet ejection performances are improved, a meniscus of ink formed at an outlet of the nozzle 180 (or bubble guide 181) after ink is sprayed due to a hydrophobic property of the droplet ejecting portion 191, is stabilized quickly, and external bubbles are prevented from being mixed in the ink disposed in an ink chamber 140. In the ink-jet printhead, owing to the presence of the bubble guide 181 and the droplet ejecting portion 191 having the diameter smaller than the bubble guide 181, a correct (exact and precise) ejecting direction of the droplets can be maintained.

The fact that there is no hydrophobic material in the ink chamber 140 in the ink-jet printhead does not limit the scope of the present invention, but is a result of a method of manufacturing an ink-jet printhead according to the present invention.

The structure of the ink-jet printhead 100 will be described in detail with reference to FIG. 2A.

Referring to FIG. 2A, the ink chamber 140 having a hemispheric shape is formed at a center of a top surface of a substrate 110. A trapezoidal channel-shaped manifold 170 is formed under the ink chamber 140. Ink is supplied from the manifold 170 to the ink chamber 140 through a passage 160 formed at a bottom of the ink chamber 140. The multilayer nozzle plate 120, which is formed by multilayer insulating layers according to a structural feature of a back-shooting method, is formed on the top surface of the substrate 110. The nozzle plate 120 is a membrane that is formed by stacks sequentially formed on the substrate 110. The nozzle plate 120 includes the nozzle 180 that is disposed at the center of the ink chamber 140. Here, the nozzle 180 includes the cylindrical bubble guide 181. The nozzle 180 further includes the droplet ejecting portion 191 that is formed on the hydrophobic coating layer 190. That is, the nozzle 180 penetrates the nozzle plate 120 and the hydrophobic coating layer 190 and has a droplet progressing path that is longer than a thickness of the nozzle plate 120 and passes through the bubble guide 181 that is extended into the ink chamber 140. As an example, the droplet ejecting portion 191 of the hydrophobic coating layer 190, which is a part of the nozzle 180, will be referred to as a portion of the nozzle 180 in the embodiments of the present invention.

The nozzle plate 120 in which the nozzle 180 is formed, includes a first insulating layer 120*a*, a second insulating layer 120*b*, and a third insulating layer 120*c*. A heater 130 surrounds the nozzle 180 and is formed between the first insulating layer 120*a* and the second insulating layer 120*b*. The heater 130 is formed adjacent to the nozzle 180 between the first insulating layer 120*a* and the second insulating layer 120*b*. An interconnection layer 150, which is to be connected to the heater 130, is formed between the second insulating layer 120*b* and the third insulating layer 120*c*. In the above structure, the third insulating layer 120*c* may be formed in a form of a multilayer stack including a passivation layer other than a single layer, and the hydrophobic coating layer 190 is formed on the third insulating layer 120*c*. The hydrophobic coating layer 190 is formed on the entire top surface of the nozzle plate 120 and includes the droplet ejecting portion 191, which has the diameter smaller than the nozzle 180 or the bubble guide 181 and has the same axis as the nozzle 180 or the bubble guide 181. A pad 122 is electrically connected to the heater 130.

Figure 2B:
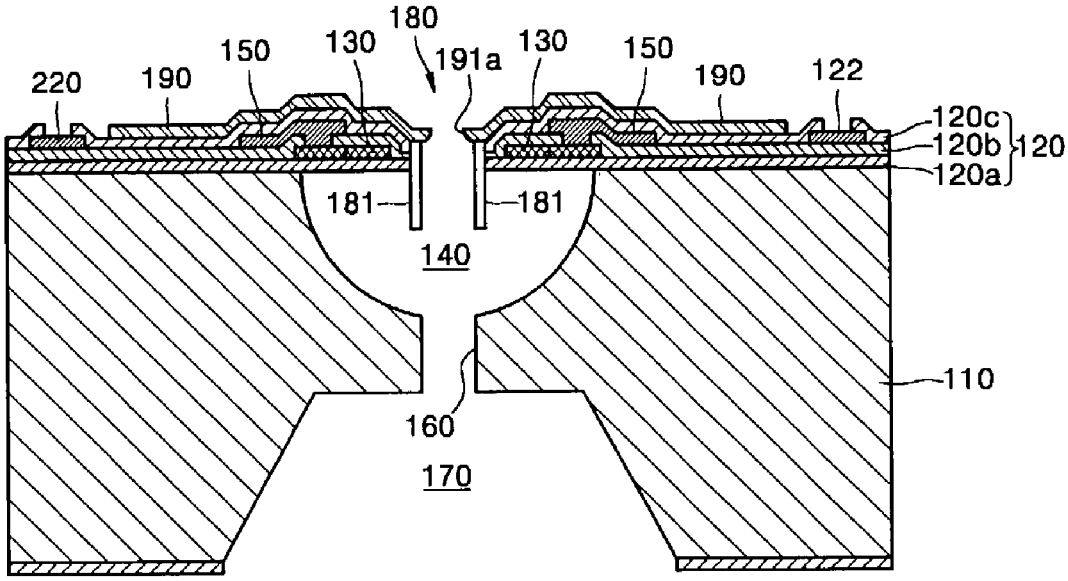
FIG. 2B is a schematic cross-sectional view illustrating an ink-jet printhead according to another embodiment of the present invention.

FIG. 2B is a schematic cross-sectional view illustrating the ink-jet printhead according to another embodiment of the present invention. In the present embodiment, a droplet ejecting portion 191*a* is formed on the hydrophobic coating layer 190 and has a cone structure in which the entire shape of the nozzle 180 becomes narrower in a droplet progressing direction. As shown in FIGS. 2A and 2B, the diameter of the droplet ejecting portion 191*a* is smaller than that of the nozzle 180 or the bubble guide 181. The hemispheric ink chamber 140 is formed at a center of the top surface of the substrate 110. The trapezoidal channel-shaped manifold 170 is to be connected to the ink chamber 140 through a passage 170 and is formed under the ink chamber 140. The multilayer nozzle plate 120 is formed by multilayer insulating layers 120*a*, 120*b*, and 120*c* sequentially formed on the top surface of the substrate 110 and is formed on the top surface of the substrate 110. The nozzle plate 120 includes the nozzle 180 that is positioned at the center of the ink chamber 140 and the cylindrical bubble guide 181 that is formed inside the nozzle plate 120.

The heater 130 surrounds the nozzle 180 and is formed between the first insulating layer 120*a* and the second insulating layer 120*b*. The interconnection layer 150 is connected to the heater 130 and formed between the second insulating layer 120*b* and the third insulating layer 120*c*. In the above structure, the hydrophobic coating layer 190 is formed on the third insulating layer 120*c*. The hydrophobic coating layer 190 is formed on the entire top surface of the nozzle plate 120 and includes the droplet ejecting portion 191*a*, which has the diameter smaller than the nozzle 180 or the bubble guide 181 and has the same axis as the nozzle 180 or the bubble guide 181. An inside surface of the droplet ejecting portion 191*a* slants with respect to the axis of the nozzle 180 and the bubble guide 181.

Figure 2C:
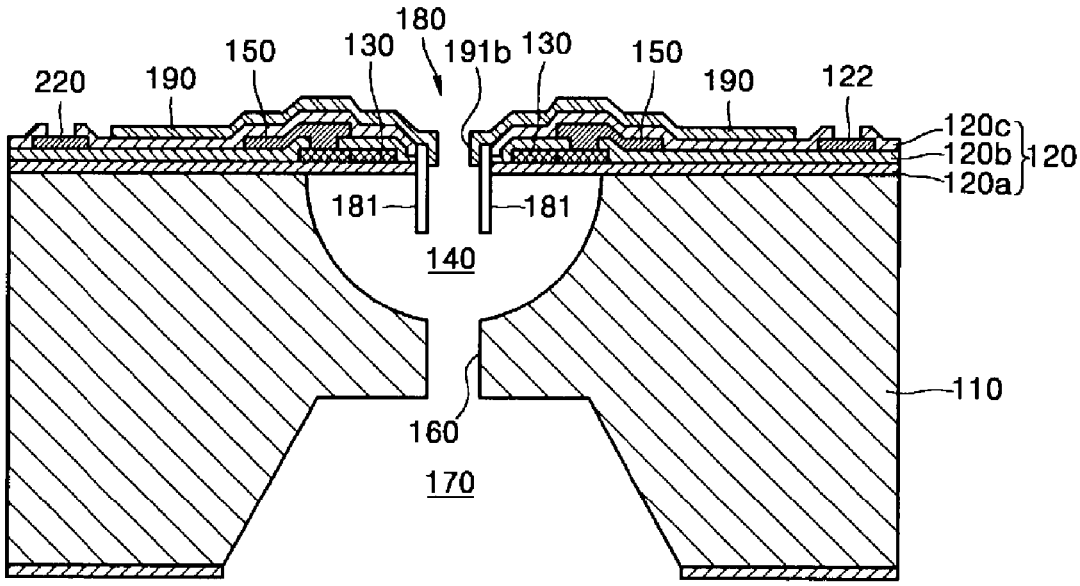
FIG. 2C is a schematic cross-sectional view illustrating an ink-jet printhead according to another embodiment of the present invention.

FIG. 2C is a schematic cross-sectional view illustrating the ink-jet printhead according to another embodiment of the present invention. A structure that is integrated with the hydrophobic coating layer 190 and includes a cylindrical droplet ejecting portion 191*b* that is extended along the nozzle 180 or the bubble guide 181 to a predetermined length toward the ink chamber 140. As with the embodiments shown in FIGS. 2A–2B, the diameter of the droplet ejecting portion 191*b* is smaller than the diameter of the nozzle 180 or the bubble guide 181. The hemispheric ink chamber 140 is formed at the center of the top surface of the substrate 110. The trapezoidal channel-shaped manifold 170 is connected to the ink chamber 140 through a passage 170 and is formed under the ink chamber 140. The multilayer nozzle plate 120 is formed by multilayer insulating layers 120*a*, 120*b*, and 120*c* sequentially formed on the top surface of the substrate 110 and is formed on the top surface of the substrate 110. The nozzle plate 120 includes a nozzle 180 disposed at the center of the ink chamber 140 and a cylindrical bubble guide 181 that is formed inside the nozzle plate 120. The heater 130 is formed between the first insulating layer 120*a* and the second insulating layer 120*b*. The interconnection layer 150 is formed between the second insulating layer 120*b* and the third insulating layer 120*c*.

Hereinafter, a method of manufacturing the ink-jet printhead of FIGS. 2A–2C will be described in greater detail. Here, a layer-forming method and a patterning method that are applied during the method of manufacturing the ink-jet printhead, are well known and do not limit the scope of the invention unless defined specifically. A common manufacturing process will be first described in the first through third embodiments of the present invention, and then, a separate manufacturing process will be respectively described in the method of forming the droplet ejecting portion 191, 191*a*, 191*b*, of FIGS. 2A–2C.

Common Manufacturing Process

Figure 3A:
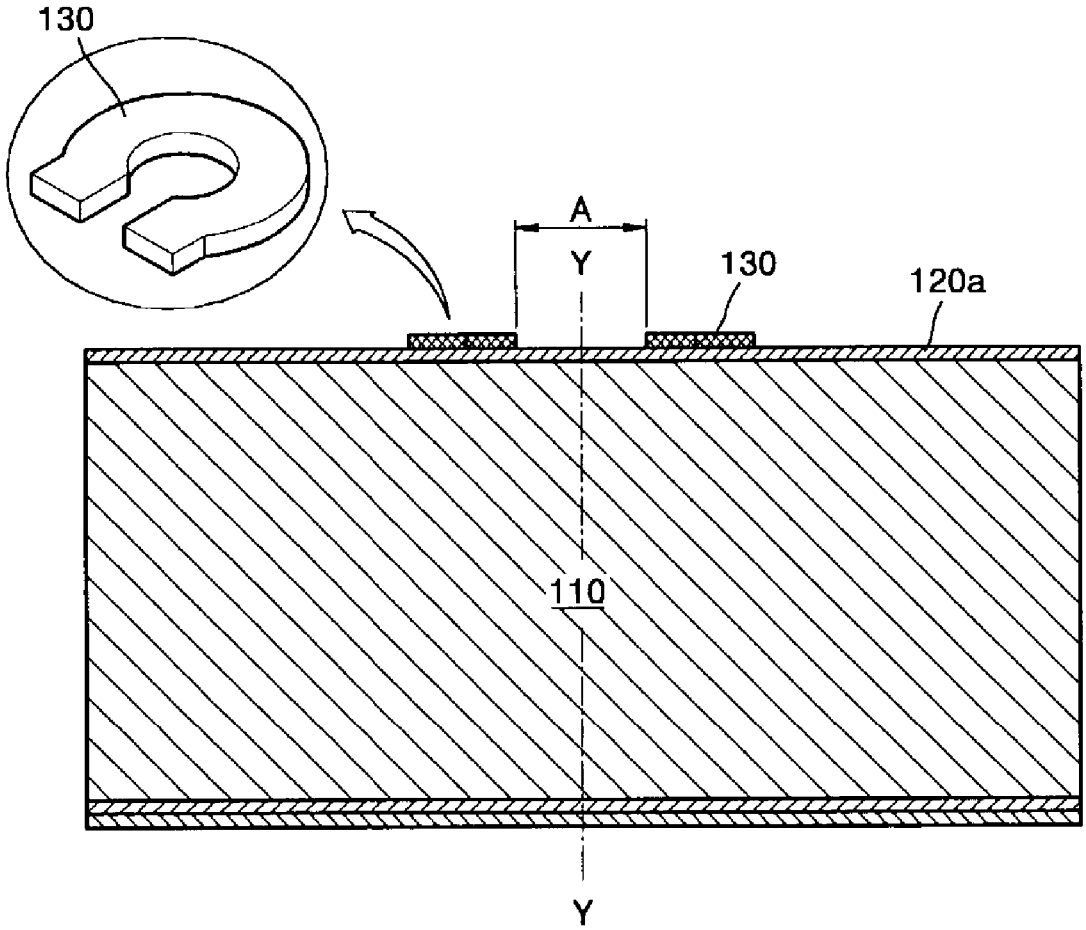
FIGS. 3A through 3K are process diagrams illustrating a method of manufacturing the ink-jet printheads shown in FIGS. 2A through 2C.

As shown in FIG. 3A, the first insulating layer 120*a* formed of silicon oxide is formed on the surface of the substrate 110, such as a Si wafer, by plasma enhanced-chemical vapor deposition (PE-CVD). Then, a ring-shaped or omega-shaped heater 130 is formed on the first insulating layer 120*a*. The heater 130 may be formed in various forms which surrounds a center axis Y—Y of a nozzle-forming area A. The heater 130 is formed by a patterning process including a process of depositing polysilicon and doping impurities and forming a mask and a reactive ion etching (RIE) process.

Figure 3B:
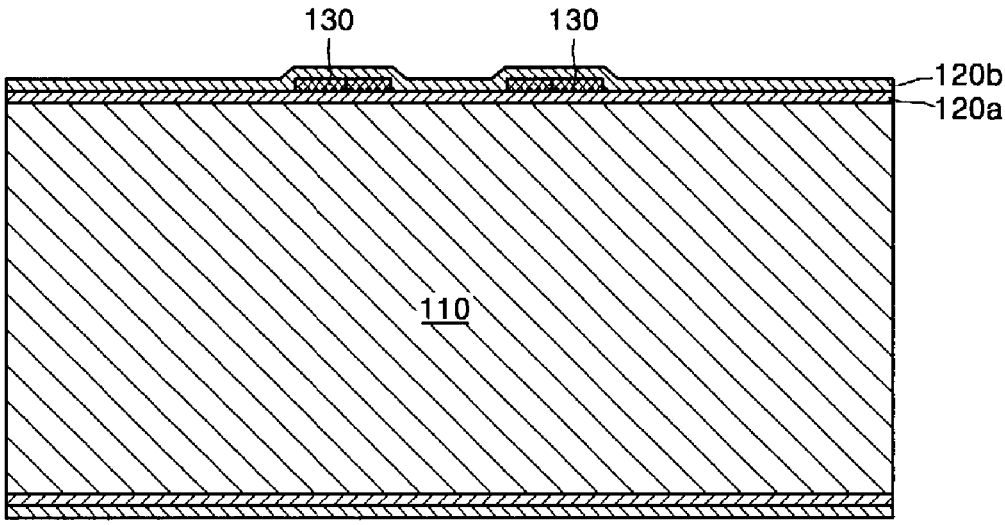

As shown in FIG. 3B, the second insulating layer 120*b* of silicon nitride ($SiN_x$) is formed on the top surface of the substrate 110 by chemical vapor deposition (CVD).

Figure 3C:
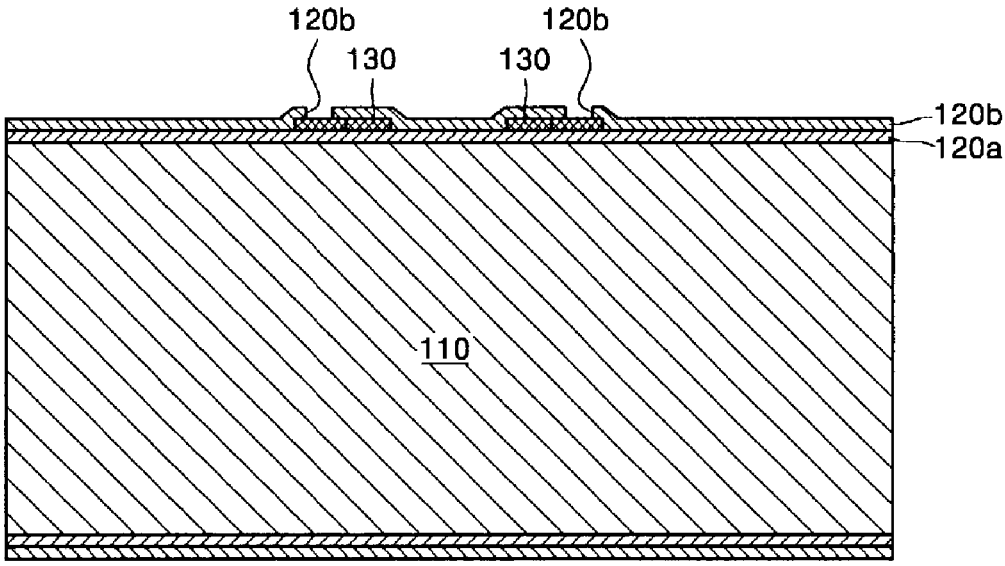

As shown in FIG. 3C, a contact hole 121*b* that is to be electrically connected to the heater 130 is formed by a photolithography process of the second insulating layer 120*b*.

Figure 3D:
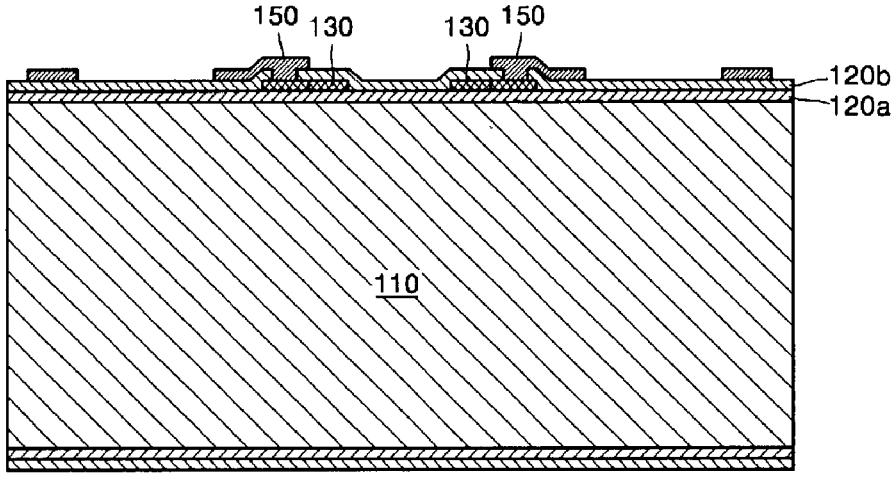

As shown in FIG. 3D, the interconnection layer 150 is formed on the second insulating layer 120*b* through the contact hole 121*b*. The interconnection layer 150 is formed by a patterning process through a photolithography process including a process of depositing aluminum or aluminum alloy, and forming a mask and etching. The pad 122 is also formed on the second insulting layer 120*b*.

Figure 3E:
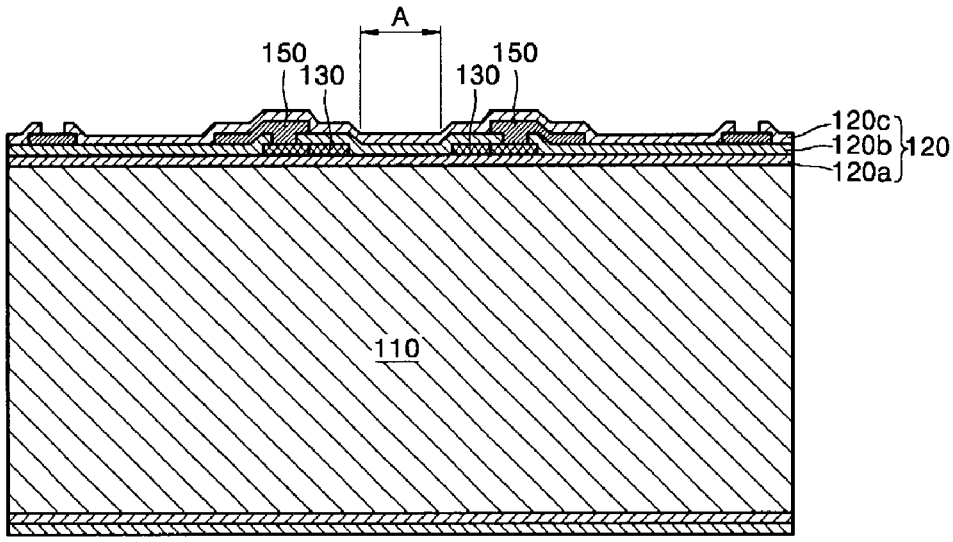

As shown in FIG. 3E, the third insulating layer 120*c* is formed on the above stack. As a result, the concave nozzle-forming area A is formed in an upper center of the heater 130 as a result of the above stack structure. In this case, the third insulating layer 120*c* is preferably an inter-metal insulating (IMD) layer. The third insulating layer 120*c* serves to protect the heater 130 and thus is needed to have enough thickness to protect the heater 130. Thus, silicon oxide is formed on the third insulating layer 120*c* by PE-CVD so that the third insulating layer 120*c* can be formed thicker.

Figure 3F:
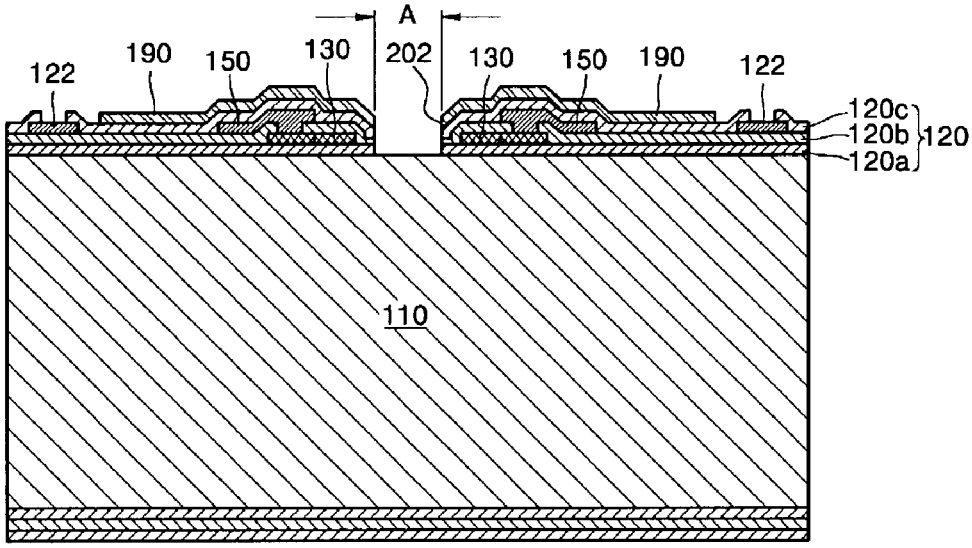

As shown in FIG. 3F, a photoresist mask layer 201 having a window which corresponds to the nozzle-forming area A is formed on the third insulating layer 120*c*, and then a portion of the insulating layers corresponding the nozzle-forming area A is removed from the substrate 110 by the RIE process.

Figure 3G:
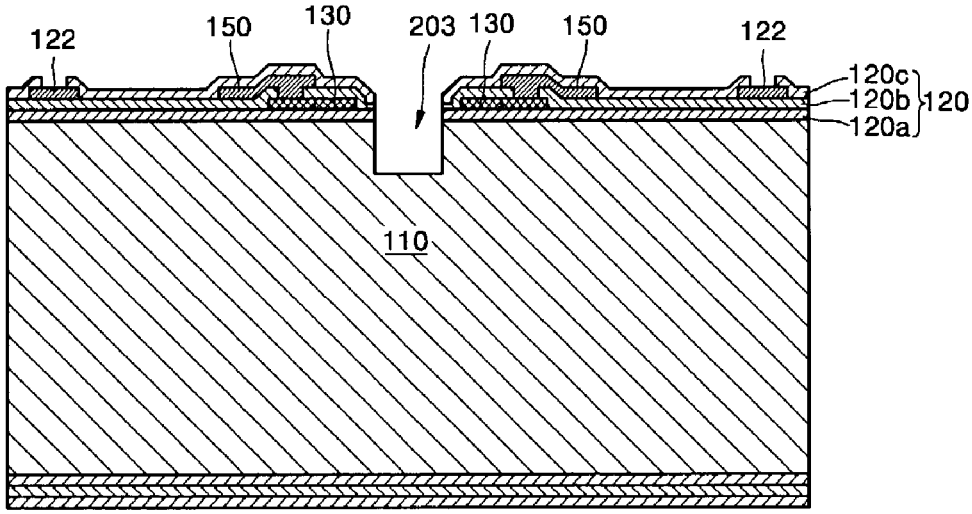

As shown in FIG. 3G, the substrate 110 in the nozzle-forming area A is etched to a predetermined depth using ICP RIE. Thus, a well 203 is formed by etching the insulating layer portion and the substrate 110. After the well 203 is formed, the mask layer 201 is removed.

Figure 3H:
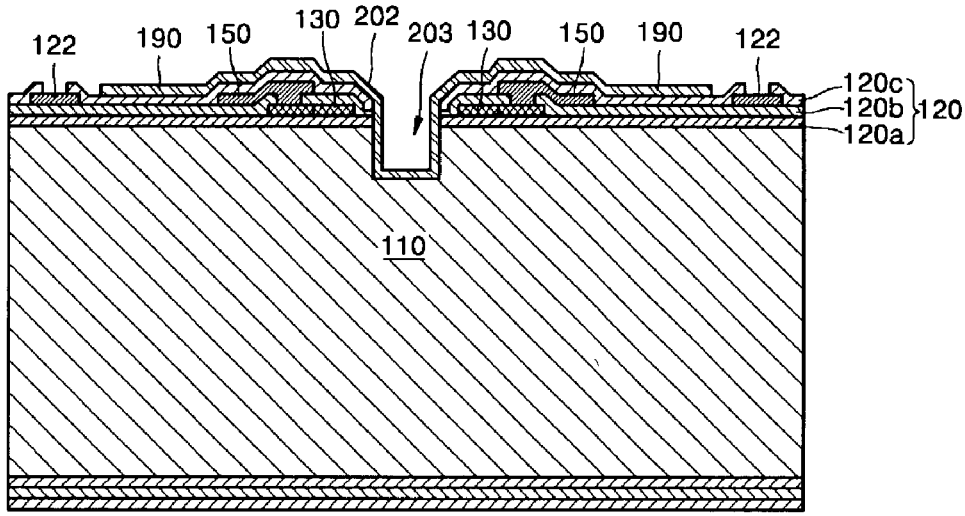

As shown in FIG. 3H, a bubble guide-forming thin layer 181*a* is formed by depositing tetraethoxysilane (TEOS) on the stack of the substrate 110 by the PE-CVD. In this case, the thin layer 181*a* is formed on the uppermost layer of the stack, an inner wall of the well 203, and an entire bottom of the well 203, to a predetermined thickness.

Figure 3I:
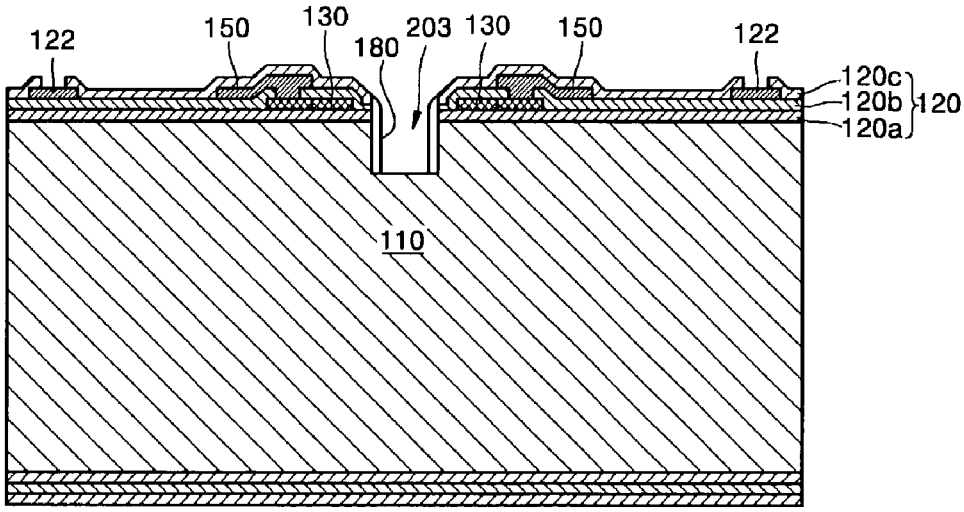

As shown in FIG. 3I, the bubble guide-forming thin layer 181*a* is removed by dry etching, such as RIE, except from the inner wall of the well 203, thereby forming a bubble guide 181.

Figure 3J:
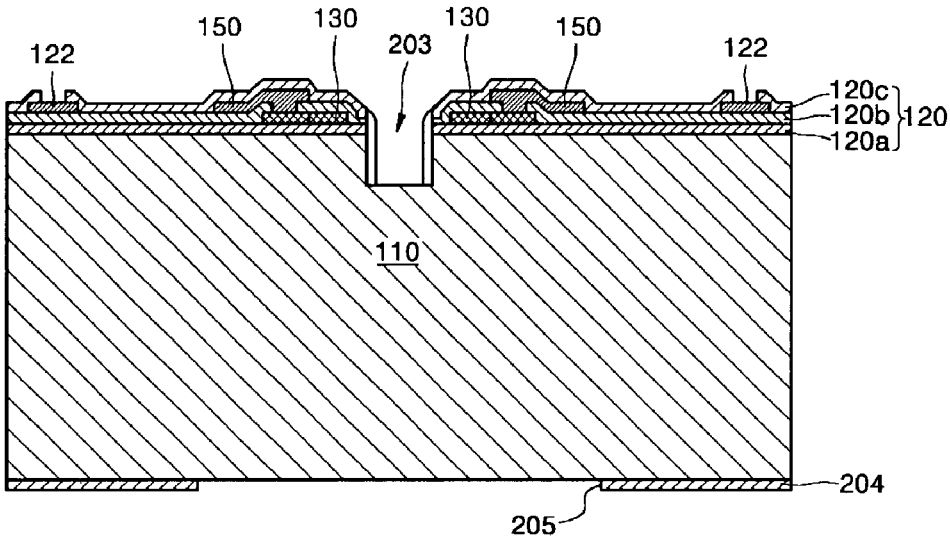

As shown in FIG. 3J, the bubble guide-forming thin layer 181*a* (bubble guide 181) is polished, and then a mask layer 204 having a manifold-forming window 205 is formed on the bottom surface of the substrate 110.

Figure 3K:
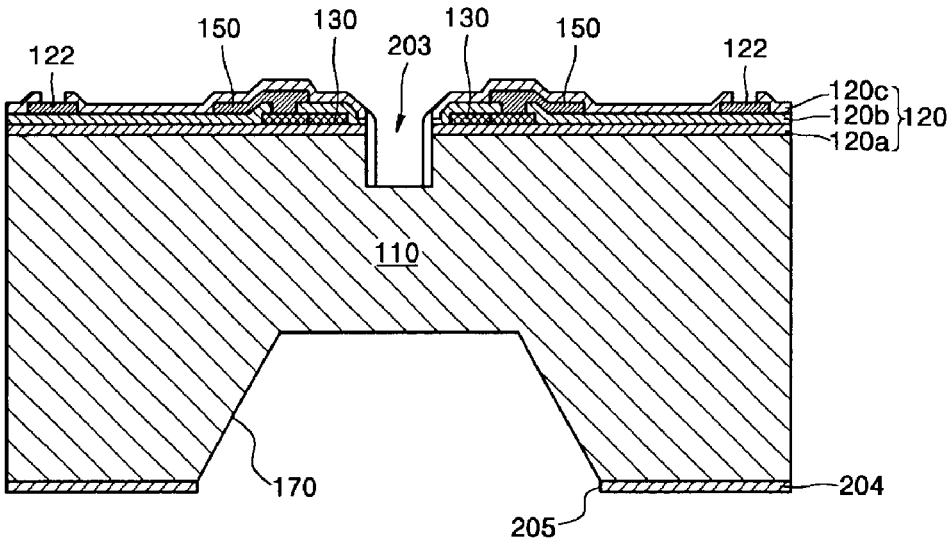

As shown in FIG. 3K, a portion of the substrate 110 that is exposed to an outside through the window 205 of the mask layer 204 is anisotropically etched to a predetermined depth, thereby forming the manifold 170.

Hereinafter, the separate manufacturing process of forming the droplet ejecting portion 191, 191*a*, 191*b* of the ink-jet printhead of FIGS. 2A–2C will be respectively described.

Separate manufacturing process of the ink-jet printhead of FIG. 2A

Figure 4A:
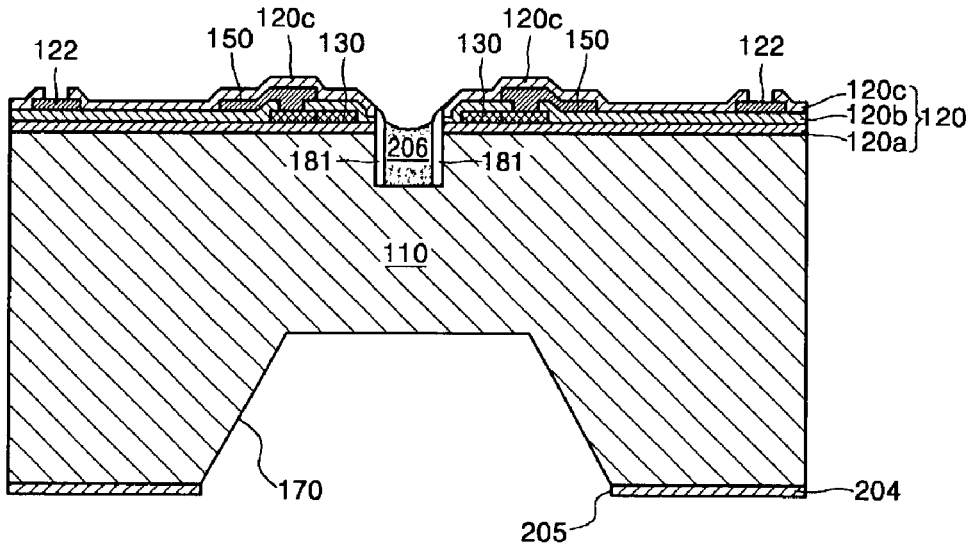
FIGS. 4A through 4D are subsequent process diagrams illustrating the method of manufacturing the ink-jet printhead shown in FIG. 2A.

As shown in FIG. 4A, the bubble guide 181 is filled with photoresist, thereby forming a sacrificial layer 206 in the bubble guide 181. In this case, the photoresist is preferably one selected from AZ 1512, AZ 1518, AZ 4330, AZ 4903, and AZ 9260 manufactured by CLARIANT. After the bubble guide 181 is filled with the photoresist by spin coating of the photoresist, by exposure of the photoresist, and by a development of the photoresist, a hard baking process is performed at a temperature of about 120 degree for about 30 minutes.

Figure 4B:
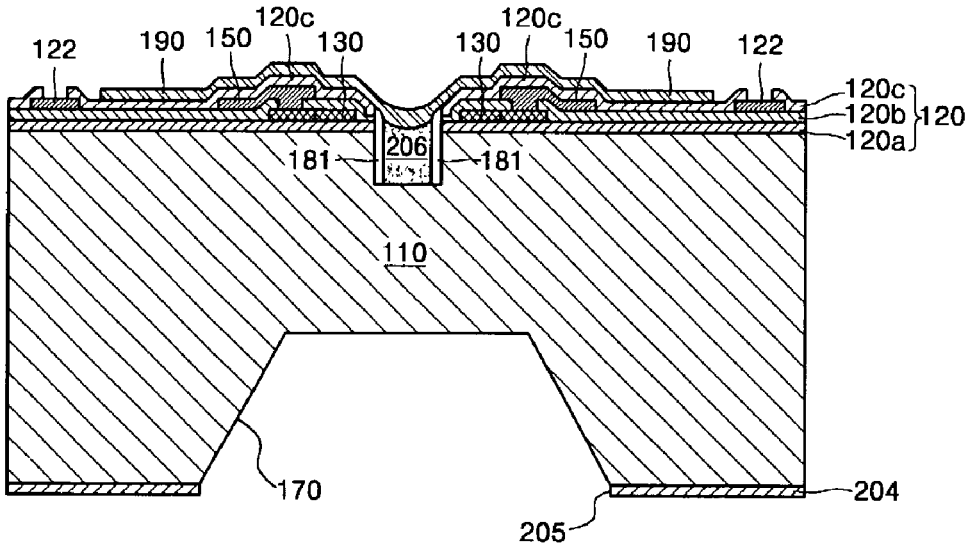

As shown in FIG. 4B, the hydrophobic coating layer 190 formed of polyimide or SU-8 manufactured by MICROCHEM CORPORATION is formed on an entire top surface of the nozzle plate 120 by spin coating. The droplet ejecting portion 191, which is disposed at a center portion of the bubble guide 181 and has a through hole shape having the diameter smaller than the bubble guide 181, is formed in the hydrophobic coating layer 190 by a photolithography process. After the droplet ejecting portion 191 is formed, the hydrophobic coating layer 190 is hard-baked and thus is solidified.

Figure 4C:
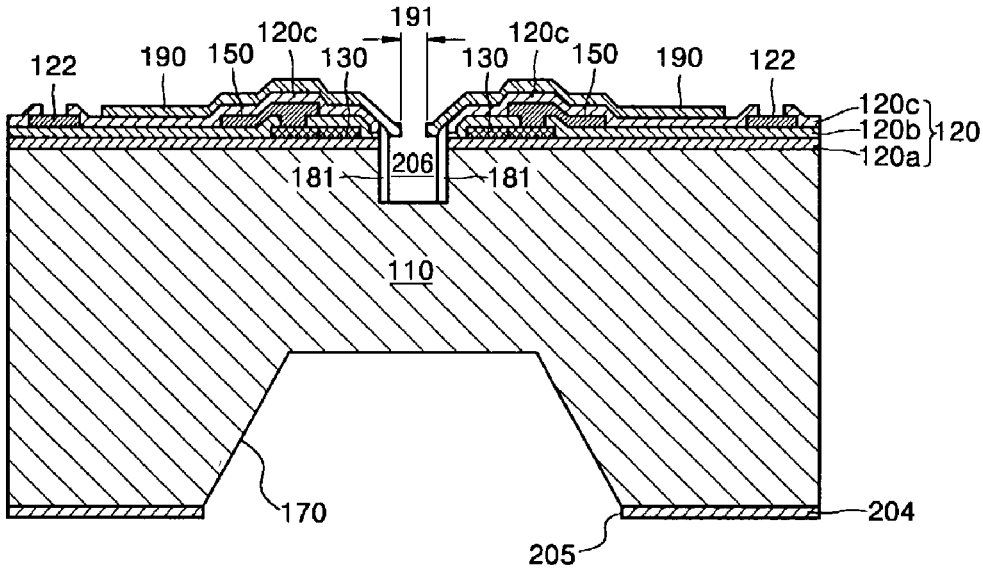
Figure 4D:
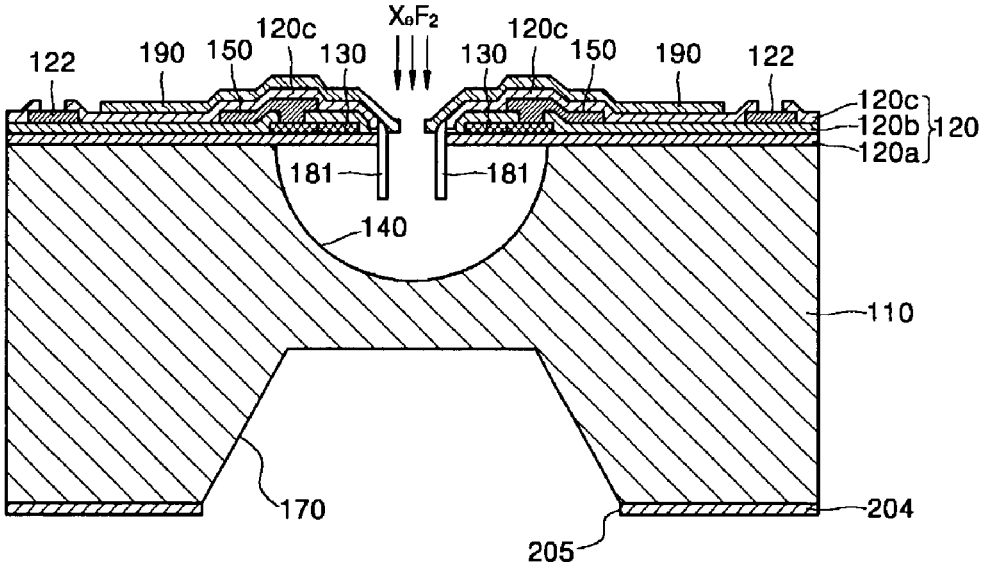

As shown in FIG. 4C, after the sacrificial layer 206 in the bubble guide 181 is removed by wet etching, an etching gas is supplied to the bubble guide 181 using a dry etching apparatus, i.e., an $XeF_2$ etching apparatus, thereby forming the hemispheric ink chamber 140 having a predetermined thickness around the bubble guide 181. Subsequently, the passage 160 is formed on the bottom of the ink chamber 140 by dry etching. Therefore, the ink-jet printhead having the droplet ejecting portion 191 shown in FIG. 2A is implemented.

Separate manufacturing process of the ink-jet printhead of FIG. 2B

Figure 5A:
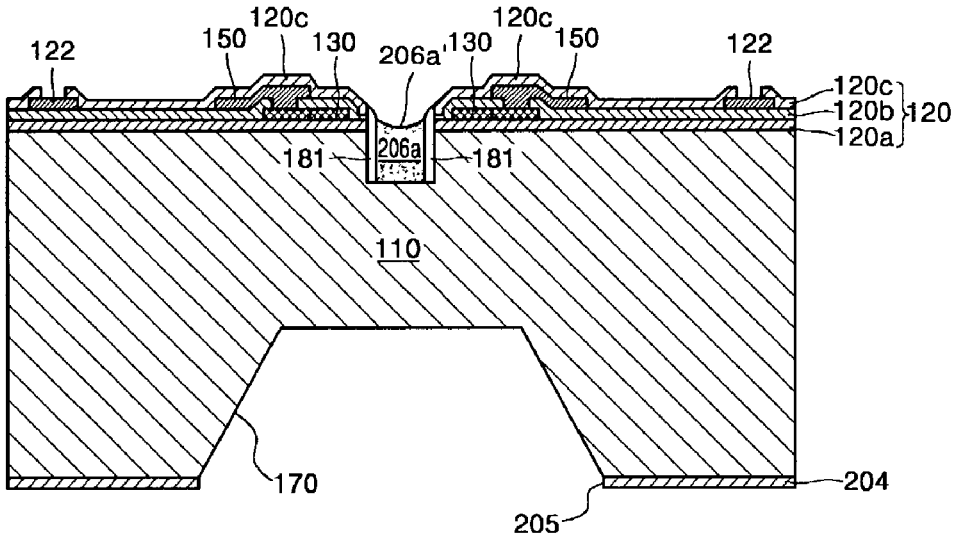
FIGS. 5A through 5D are subsequent process diagrams illustrating the method of manufacturing the ink-jet printhead shown in FIG. 2B.
Figure 7A:
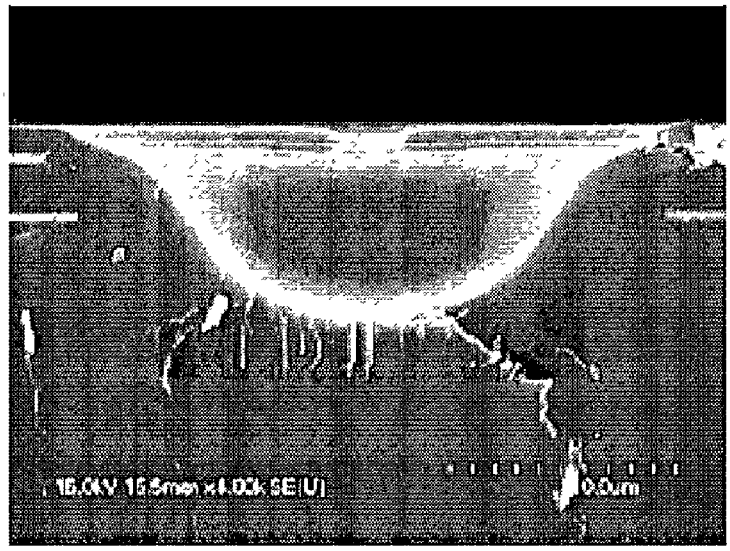
FIG. 7A is a SEM photo corresponding to the process described in FIG. 5A of the method of manufacturing the ink-jet printhead shown in FIG. 2B.

As shown in FIG. 5A, the bubble guide 181 is filled with the photoresist, thereby forming the sacrificial layer 206*a* in the bubble guide 181. In this case, a concave portion 206*a*', like a concave lens, is formed on the sacrificial layer 206*a*. In this case, the photoresist is preferably one selected from AZ 1512, AZ 1518, AZ 4330, AZ 4903, and AZ 9260 manufactured by CLARIANT. After the bubble guide 181 is filled with photoresist by spin coating of the photoresist, by the exposure of the photoresist and by the development of the photoresist, the hard baking process is performed at a temperature of about 120 degree for about 30 minutes. FIG. 7A is a SEM photo illustrating a case where the concave portion is formed on the sacrificial layer 206*a*. A shape of the concave portion 206*a*' may be easily obtained by properly adjusting viscosity of the photoresist and a rotation speed during the spin coating process.

Figure 5B:
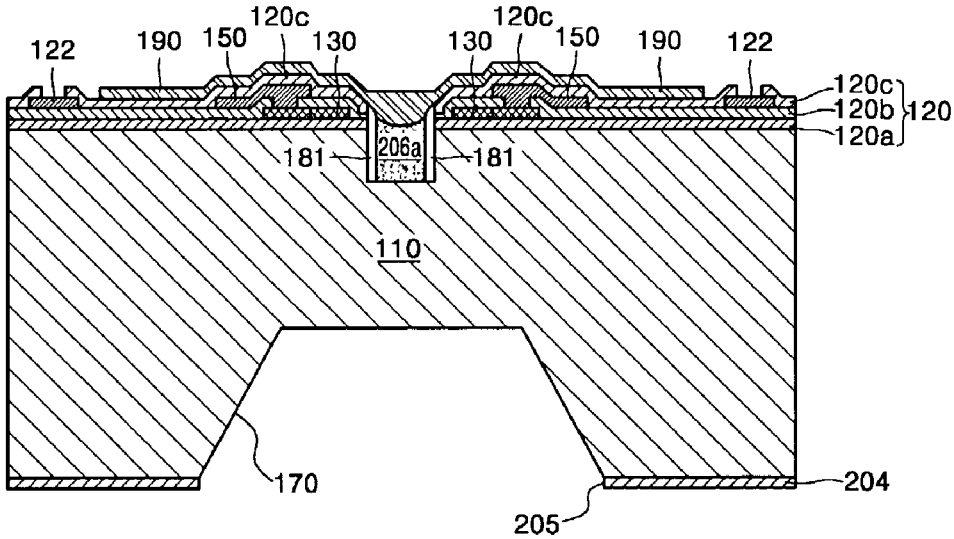

As shown in FIG. 5B, the hydrophobic coating layer 190 is formed to a predetermined thickness by spin coating on the entire top surface of the nozzle plate 120 and the upper concave portion 206*a*' of the sacrificial layer 206*a*.

Figure 5C:
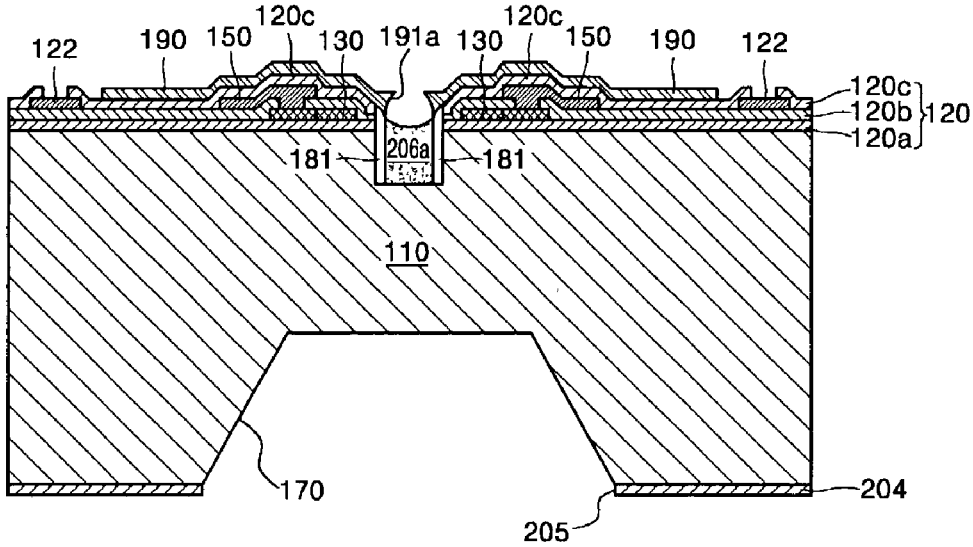
Figure 7B:
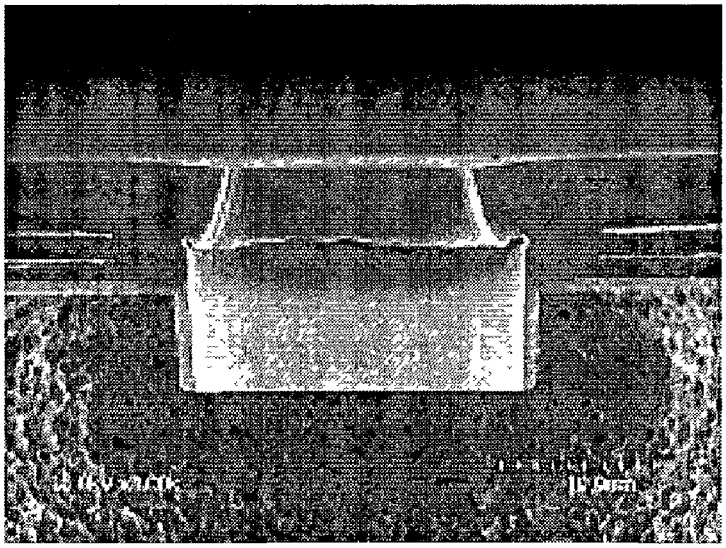
FIG. 7B is a SEM photo corresponding to the process described in FIG. 5C of the method of manufacturing the ink-jet printhead shown in FIG. 2B.

As shown in FIG. 5C, the droplet ejecting portion 191*a*, which is disposed at the center of the bubble guide 181 and has the through hole shape having the diameter smaller than the diameter of the bubble guide 181, is formed in the hydrophobic coating layer 190 by the photolithography process. After the droplet ejecting portion 191 a is formed, the hydrophobic coating layer 190 is hard-baked and thus is solidified. FIG. 7B is a SEM photo illustrating a case where the through hole-shaped droplet ejecting portion 191*a* is formed. As shown in FIG. 7B, the through hole-shaped droplet ejecting portion 191*a* has the diameter smaller than the diameter of the bubble guide 181 and has the cone shape having the diameter that is gradually reduced in the droplet progressing direction. This shape is formed when a portion of the hydrophobic layer 190, in particular, a sharply shaped-remaining portion of the hydrophobic layer 190 around the nozzle, is contracted in a direction where surface energy is reduced, during the baking process by heating to a half melted state.

Figure 5D:
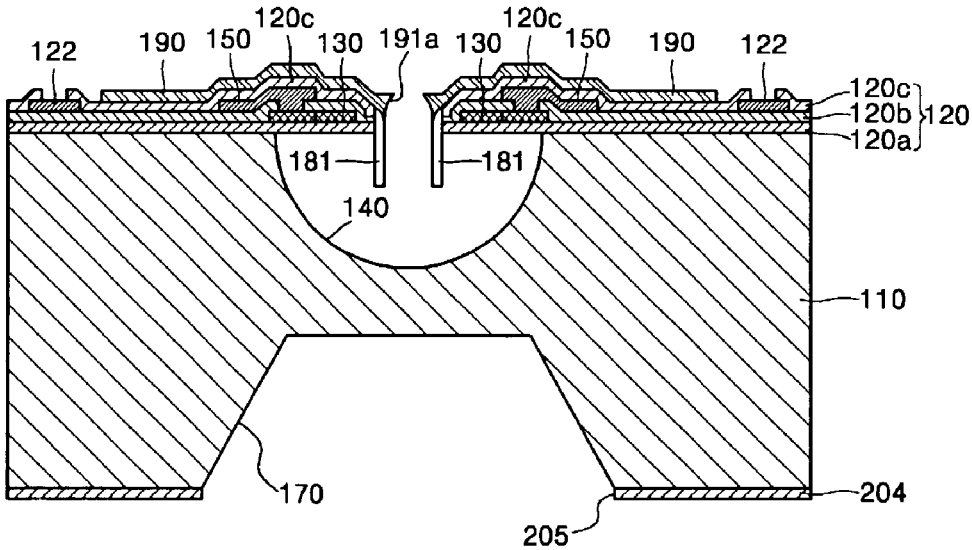

As shown in FIG. 5D, after the sacrificial layer 206*a* in the bubble guide 181 is removed by wet etching, an etching gas is supplied to the bubble guide 181 using a dry etching apparatus, i.e., an $XeF_2$ etching apparatus, thereby forming the hemispheric ink chamber 140 having a predetermined thickness around the bubble guide 181. Subsequently, the passage 160 is formed on the bottom of the ink chamber 140 by dry etching. Therefore, an ink-jet printhead having the shape shown in FIG. 2B is implemented.

Separate manufacturing process of the ink-jet printhead of FIG. 2C

Figure 6A:
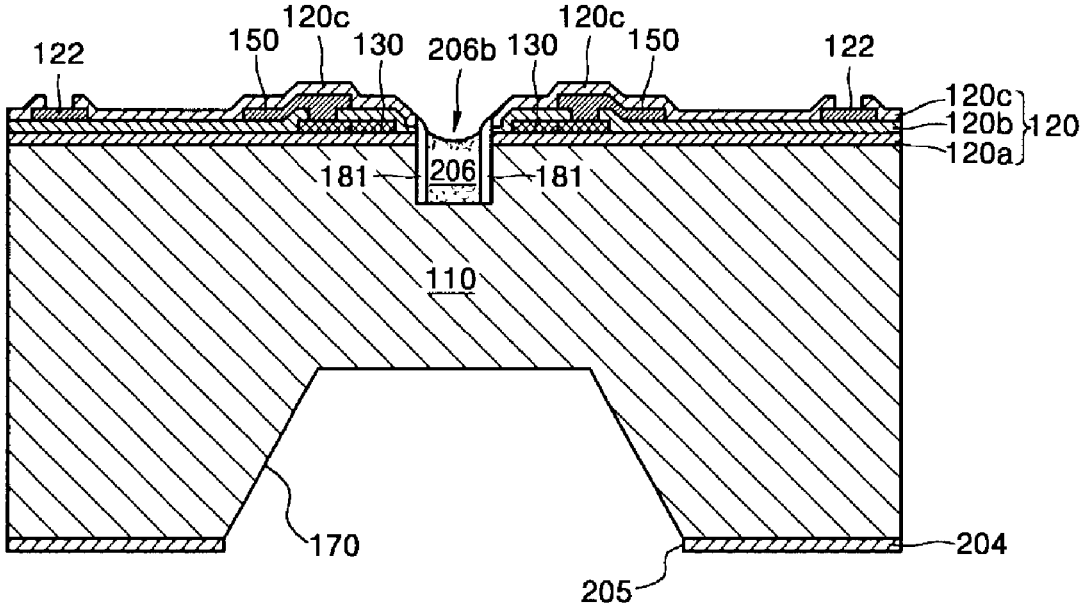
FIGS. 6A through 6D are subsequent process diagrams illustrating the method of manufacturing the ink-jet printhead shown in FIG. 2C.

As shown in FIG. 6A, the bubble guide 181 is filled with the photoresist, thereby forming the sacrificial layer 206*b* in the bubble guide 181. In this case, the sacrificial layer 206*b* formed using the photoresist has a height lower than the bubble guide 180, and thus the inside of the bubble guide 181 is exposed to an upper portion of the sacrificial layer 206*b*. Here, the photoresist in use is preferably one selected from AZ 1512, AZ 1518, AZ 4330, AZ 4903, and AZ 9260 manufactured by CLARIANT. After the bubble guide 181 is filled with the photoresist by spin coating of the photoresist, by the exposure of the photoresist and by the development of the photoresist, the hard baking process is performed at a temperature of about 120 degree for about 30 minutes.

Figure 6B:
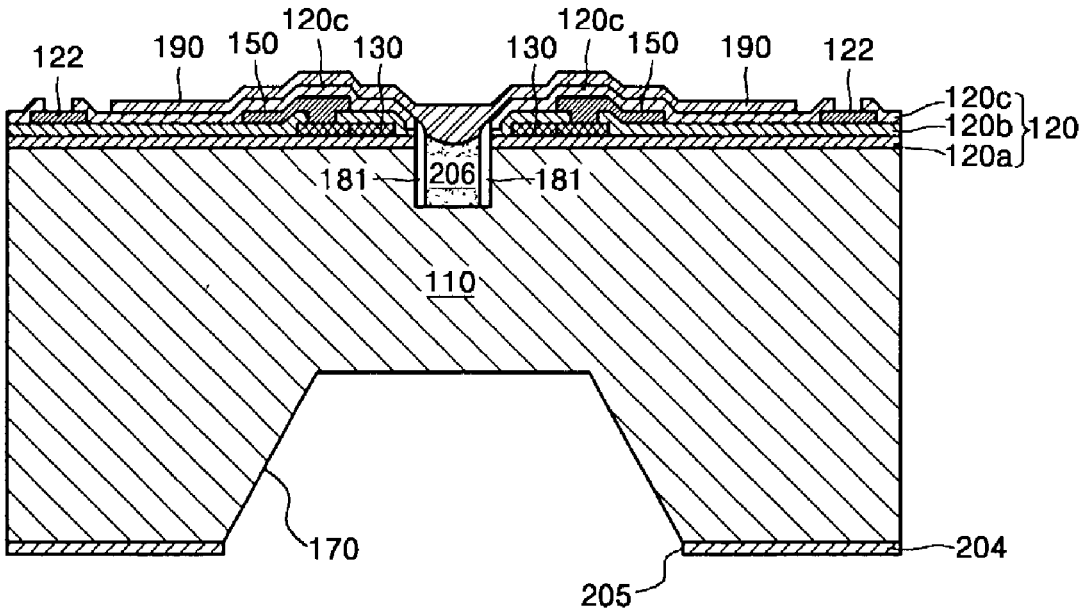

As shown in FIG. 6B, the hydrophobic coating layer 190 formed of negative photoresist, such as polyimide or SU-8 manufactured by MICROCHEM CORPORATION, is formed on the entire top surface of the nozzle plate 120 and the top surface of the sacrificial layer 206*b* by spin coating. Thus, the hydrophobic coating layer 190 is formed on an inside of the upper portion of the bubble guide 181 that is exposed to the upper portion of the sacrificial layer 206*b*.

Figure 6C:
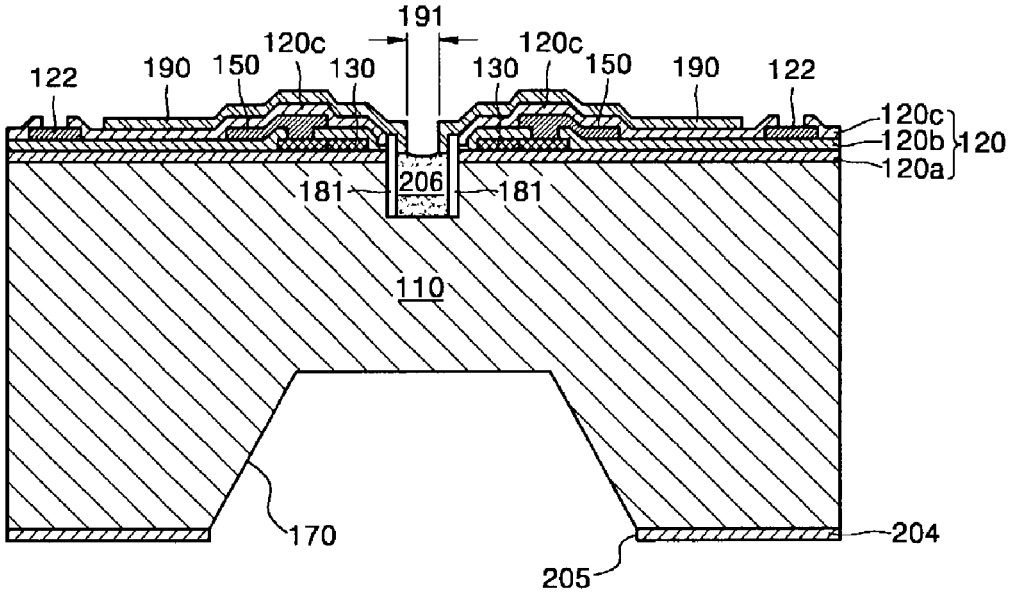

As shown in FIG. 6C, the cylindrical droplet ejecting portion 191*b*, which is disposed at the center of the bubble guide 181 and has a cylindrical shape having the diameter smaller than the bubble guide 181, is formed in the hydrophobic coating layer 190 by the photolithography process. When the photoresist is light-curing negative photoresist, the hydrophobic coating layer 190 which contacts the inside of the bubble guide 181, covers a portion of the bubble 181 and the top surface of the nozzle plate 120 such that the cylindrical droplet ejecting portion 191*b*, which is a part of the hydrophobic coating layer 190, is obtained in the upper inside of the bubble guide 181. After the cylindrical droplet ejecting portion 191*b* is formed, the hydrophobic coating layer 190 is hard-baked such that the cylindrical droplet ejecting portion 191*b* in the bubble guide 181 and the hydrophobic coating layer 190 on the top surface of the nozzle plate 120 are solidified.

Figure 6D:
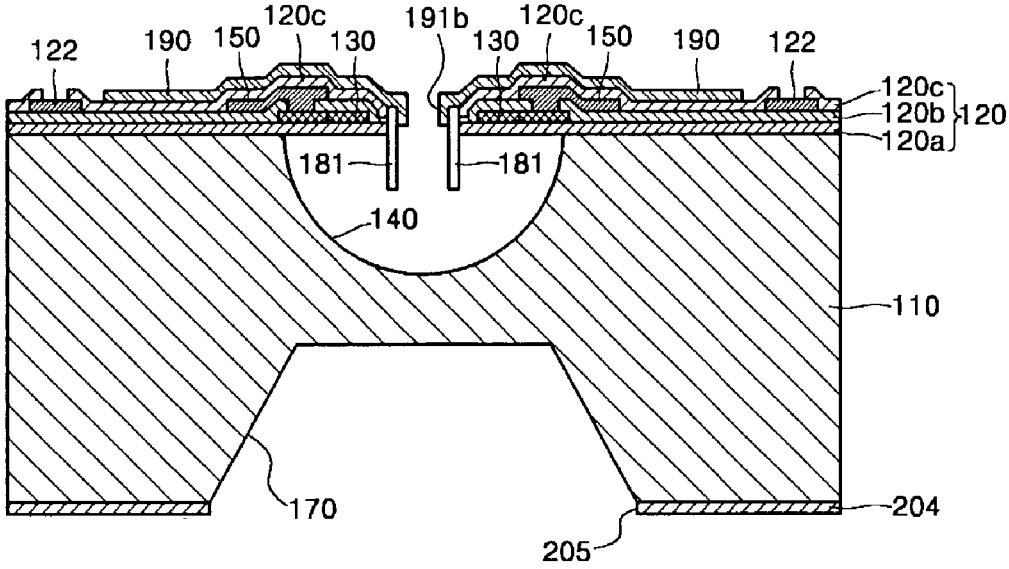

As shown in FIG. 6D, after the sacrificial layer 206*b* in the bubble guide 181 is removed by wet etching, an etching gas is supplied to the bubble guide 181 using a dry etching apparatus, i.e., an $XeF_2$ etching apparatus, thereby forming the hemispheric ink chamber 140 having a predetermined thickness around the bubble guide 181. Subsequently, the passage 160 is formed on the bottom of the ink chamber 140 by dry etching. Therefore, the ink-jet printhead having the shape shown in FIG. 2C is implemented.

As described above, the nozzle has the shape in which the slanting enlarged and opened portion around the nozzle caused by the structural profile of the stack forming the nozzle plate. The diameter of the nozzle is reduced gradually in the droplet ejecting direction by forming the droplet ejecting portion using the photoresist, and the nozzle is formed such that the speed and straight-traveling property of ink droplets are improved. That is, by properly adjusting the shape and size of the nozzle, the ink-jet printhead having improved droplet ejection performances is obtained.

Since the hydrophobic coating layer with the hydrophobic property surrounds the top end portion of the bubble guide, the ink-jet printhead is advantageous for movement of the meniscus of ink that is formed in the bubble guide, the meniscus of ink is stabilized quickly after the droplets are ejected, and thus the stability of ink spray and a consecutive spray performance are improved.

In the ink-jet printhead according to the present invention, the droplet ejecting portion is provided in the hydrophobic coating layer to prevent the nozzle plate from being wet due to ink and to improve the droplet ejection on performance. Thus, the ink-jet printhead according to the present invention does not require an additional process of forming the droplet ejecting portion separately.

In the method of manufacturing an ink-jet printhead according to the present invention, the droplet ejecting portion having a desired shape, that is, a droplet ejecting portion having a diameter smaller than the diameter of the bubble guide, in particular, the droplet ejecting portion having the diameter that is reduced gradually in the droplet progressing direction can be easily obtained using the photoresist.

In addition, in a method of manufacturing an ink-jet printhead according to the present invention, the diameter of the droplet ejecting portion in which the droplets are finally ejected can be reduced and can be modified in various forms by the photolithography process. Thus, the droplet ejection speed and droplet amount can be easily adjusted regardless of the shape around the nozzle through which the droplets are ejected, and the straight-traveling property of the droplets and the droplet ejection speed can be improved.

In addition, in a method of manufacturing an ink-jet printhead according to the present invention, the hydrophobic material is thoroughly prevented from penetrating into the ink chamber and thus problems caused by the presence of the hydrophobic material in the ink chamber do not occur when the nozzle plate is prevented from being wet using the hydrophobic coating layer.

While this invention has been particularly shown and described with reference to preferred embodiments thereof, it will be understood by those skilled in the art that various changes in form and details may be made therein without departing from the spirit and scope of the invention as defined by the appended claims and equivalents thereof.

What is claimed is:

1. An ink-jet printhead comprising:

a substrate having an ink chamber having a predetermined volume and formed on a first surface of the substrate, and having a passage supplying ink to the ink chamber formed on a second surface of the the substrate;

a nozzle plate having a nozzle corresponding to a center of the ink chamber, and having at least two insulating layers formed on the substrate;

a bubble guide formed on an inside surface of the nozzle plate to define the nozzle, through which the ink is ejected, and extending from the nozzle into the ink chamber;

a heater which surrounds the nozzle and is disposed between the two insulating layers;

a hydrophobic coating layer formed on a surface of an uppermost outside layer of the nozzle plate; and a droplet ejecting portion having a diameter smaller than that of the nozzle of the nozzle plate and which abruptly enlarges at an outer surface thereof.

2. The printhead of claim 1, wherein the droplet ejecting portion comprises:

a cylindrical portion formed on an inside surface of the bubble guide of the nozzle plate torward the ink chamber.

3. The printhead of claim 1, wherein the hydrophobic coating layer is formed of negative photoresist.

4. The printhead of claim 1, wherein the hydrophobic coating layer forms the droplet ejecting portion.

5. The printhead of claim 1, wherein the droplet ejecting portion is formed outside of the nozzle.

6. The printhead of claim 1, wherein the droplet ejecting portion is disposed on the same axis as the nozzle.

* * * * *

UNITED STATES PATENT AND TRADEMARK OFFICE

CERTIFICATE OF CORRECTION

PATENT NO. : 6,994,422 B2
APPLICATION NO. : 10/299905
DATED : February 7, 2006
INVENTOR(S) : Byung-ha Park et al.

It is certified that error appears in the above-identified patent and that said Letters Patent is hereby corrected as shown below:

On the Title Page, Column 2, line 11, (Abstract), after "of" replace "a" with --an--, therefor;

Column 12, line 2, Claim 1, before "substrate" delete --the--;

Column 12, line 22, Claim 2, replace "torward" with --toward--.

Signed and Sealed this

Eleventh Day of July, 2006

JON W. DUDAS
*Director of the United States Patent and Trademark Office*